US005179381A

United States Patent [19]

Hatakeyama

[11] Patent Number: 5,179,381

[45] Date of Patent: Jan. 12, 1993

[54] ELECTROMAGNETIC WAVE ABSORBER FOR VHF TO UHF BAND

[75] Inventor: Kenichi Hatakeyama, Tokyo, Japan

[73] Assignee: NEC Corporation, Tokyo, Japan

[21] Appl. No.: 775,042

[22] Filed: Oct. 11, 1991

[30] Foreign Application Priority Data

Oct. 12, 1990 [JP] Japan ..... 2-274593

[51] Int. Cl.[5] ..... H01Q 17/00; G21F 1/10

[52] U.S. Cl. ..... 342/1; 523/137

[58] Field of Search ..... 342/1; 523/137

[56] References Cited

U.S. PATENT DOCUMENTS

| | | | |
|---|---|---|---|
| 3,737,903 | 6/1973 | Suetake et al. | 342/1 |
| 4,003,840 | 1/1977 | Ishino et al. | 342/1 X |
| 4,538,151 | 8/1985 | Hatakeyama | 342/1 |
| 4,960,633 | 10/1990 | Hiza et al. | 428/215 |

*Primary Examiner*—Gilberto Barrón, Jr.

*Attorney, Agent, or Firm*—Leydig, Voit & Mayer

[57] ABSTRACT

An electromagnetic wave absorber available for a VHF to UHF band is implemented by a conductive film, a magnetic film laminated on the conductive film and back-plated with a metal film, and the magnetic film is formed from a resin film containing ferrite powder equal to or greater than 70% by weight so that the electromagnetic wave absorber is flexible and available for a large and wide structure.

14 Claims, 4 Drawing Sheets

ELECTROMAGNETIC WAVE ABSORBER FOR VHF TO UHF BAND

FIELD OF THE INVENTION

This invention relates to an electromagnetic wave absorber for very high frequency to ultra high frequency band, which is hereinbelow abbreviated as VHF to UHF band, and, more particularly, to an electromagnetic wave absorber for restricting reflection and scattering.

DESCRIPTION OF THE RELATED ART

A planar electromagnetic wave absorber for more than 1 GHz is formed by using a resin film containing conductive powder such as carbon or a resin film containing magnetic powder such as ferrite. A multiple level structure is available for more than 1 GHz. The thickness of the resin film is regulated to a quarter of the representative wavelength of the electromagnetic wave for forming a resonant circuit, and substances with large dielectric constants or large permeabilities decrease the total thickness of the electromagnetic wave absorber.

However, currently available substances are not so large in dielectric constant or permeability that the total thickness of the electromagnetic wave absorber for the VHF to UHF band is as thick as tens of centimeters. Moreover, acceptable absorption is achieved in a narrow band range for the electromagnetic wave, and commercial planar electromagnetic wave absorbers presently available are negligible.

A planar electromagnetic wave absorber for VHF to UHF band currently available was proposed by Naito et. al. in Papers of Electron Communication Society, January 1969, Vol. 52-B, No. 1, page 26. Naito et. al. proposed to use a ceramic plate of ferrite with thickness of several millimeters which resulted in U.S. Pat. No. 3,737,903. The permeability mu of the ferrite ceramic is represented as $mu = mu' - j \times mu''$, and the imaginary part mu'' is much larger than the real part mu', ie. $mu'' >> mu'$. The mu'' is substantially inversely proportional to the frequency of the electromagnetic wave. Therefore, a ceramic plate of ferrite which is several millimeters thick effectively takes up electromagnetic waves in the VHF to UHF band, and is commercially available.

However, a problem is encountered in the prior art planar electromagnetic wave absorber with the ceramic plate in brittleness and poor flexibility. For this reason, a wide electromagnetic wave absorber is hardly produced, and careful handling is necessary in construction work.

SUMMARY OF THE INVENTION

It is therefore an important object of the present invention to provide an electromagnetic wave absorber for the VHF to UHF band which is less brittle and, accordingly, available for a large and wide structure.

To accomplish the object, the present invention proposes to form a magnetic film from a resin film containing ferrite powder.

In accordance with the present invention, there is provided an electromagnetic wave absorber used for electromagnetic wave in a very high frequency to ultra high frequency band, comprising: a) a first conductive film structure having a surface; b) a magnetic film formed from a resin film containing ferrite ceramic particles and laminated on the surface of the first conductive film structure; and c) a second conductive film laminated on the opposite surface of the magnetic film to the surface attached to the first conductive film structure, and having reflecting characteristics substantially equivalent to metal.

BRIEF DESCRIPTION OF THE DRAWINGS

The features and advantages of the electromagnetic wave absorber according to the present invention will be more clearly understood from the following description taken in conjunction with the accompanying drawings in which.

DESCRIPTION OF THE PREFERRED EMBODIMENTS

First Embodiment

Figure 1:
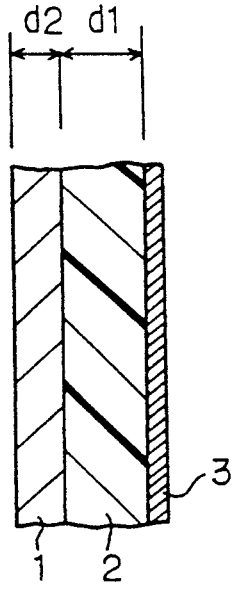
FIG. 1 is a cross sectional view showing the structure of an electromagnetic wave absorber according to the present invention.

Referring first to FIG. 1 of the drawings, an electromagnetic wave absorber embodying the present invention largely comprises a first conductive film structure 1, a magnetic film 2 and a second conductive film 3. The magnetic film 2 is formed of a resin film containing ferrite ceramic particles, and ranges from 3 millimeters to 50 millimeters in thickness. The second conductive film 3 is formed from textile fabric of metal fibers. However, any substance as large in reflection characteristics as metal is available for the second conductive film 3. In this instance, the first conductive film structure is implemented by a single conductive film formed of a resin containing carbon particles , and ranges from 3 millimeters to 100 millimeters in thickness. The first conductive film structure 1 and the magnetic film 2 have an equivalent capacitive reactance jwC and an equivalent inductive reactance jwL, and a loss factor is provided by both of the first conductive film structure 1 and the magnetic film 2. The equivalent capacitive reactance jwC, the equivalent inductive reactance jwL and the loss factor form a resonant circuit, and the permeability of the ferrite powder and the dielectric constant of the first conductive film structure 1 allow the resonant circuit to satisfy the resonant condition and the matching condition for a wide band range as will be described below.

Figure 2:
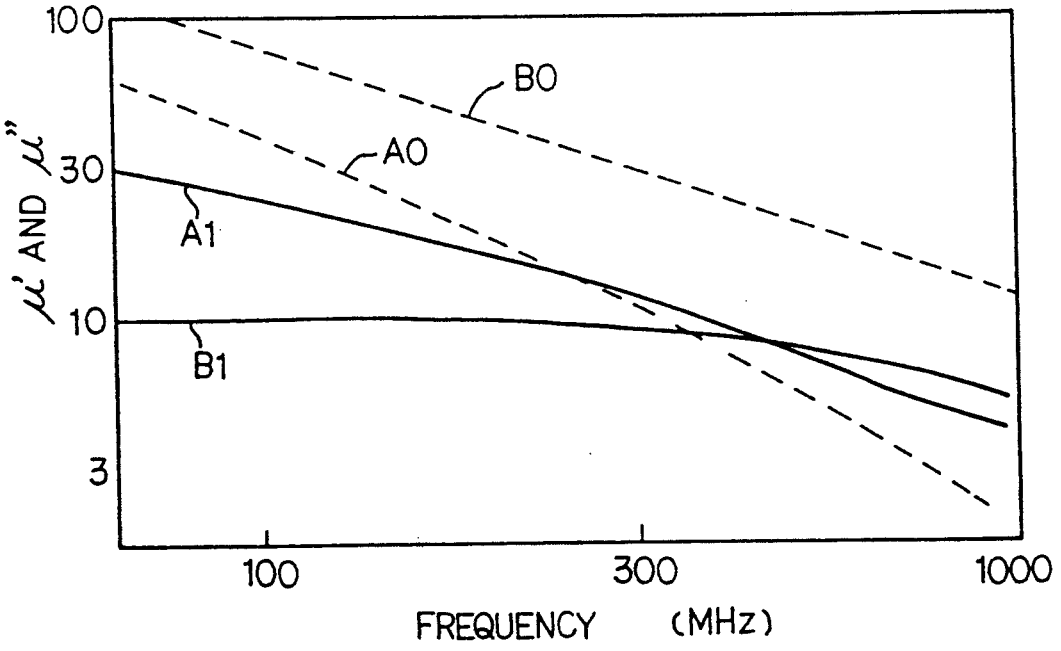
FIG. 2 is a graph showing the relation between the permeability of a resin film containing ferrite ceramic particles and frequency of electromagnetic wave.

As described hereinbefore, the permeability of the ceramic is defined as (mu'- jmu''), and the mu'' is much larger than the mu' in the range between tens orders of magnitude in the tens MHz and of orders of magnitude in the hundreds of MHz in so far as the ceramic is in the form of bulk body. Plots A0 and B0 of FIG. 2 are indicative of the mu' and mu'' of the ceramic bulk of ferrite. The mu'' is substantially in inverse proportion to the frequency of electromagnetic wave incident thereto. However, the ferrite ceramic in the Ni-Zn system is pulverized into ferrite ceramic powder with grain size of about 1 millimeter, and the ferrite ceramic powder is dispersed in resin at 90% by weight. The permeability of the resin thus containing the ferrite ceramic powder is measured, and plots A1 and B1 stand for the mu' and the mu'', respectively. Although the mu' is smaller than the mu'' in an extremely high frequency range, the mu' is larger than the mu'' in the range between orders of magnitude in the tens of MHz and orders of magnitude in the hundreds of MHz, and the relation between the mu'' and mu' is inverse to that of the ferrite ceramic bulk. Therefore, the theory of the ferrite ceramic bulk is not directly applicable to the resin film containing the ferrite ceramic powder.

However, if the magnetic film 2 is laminated on the first conductive film structure, the first conductive film structure 1 and the magnetic film 2 produce a resonant circuit, and the resonant circuit takes up electromagnetic waves in resonant condition. Since the first conductive film structure 1 and the magnetic film 2 respectively range between 3 millimeters to 100 millimeters and between 3 millimeters and 50 millimeters, the thickness is much smaller than the wavelength of electromagnetic waves in the VHF to UHF band. For example, an electromagnetic wave at 100 MHz is as long in wavelength as 3 meters, and the wavelength is much longer than the thickness of the electromagnetic wave absorber In this situation, the magnetic film 2 is equivalent to a serial impedance (R+jwL) provided in a propagation path, and the first conductive film structure 1 is equivalent to a parallel admittance (G2+jwC2 ) provided in the propagation path as shown in FIG. 3.

Figure 3:
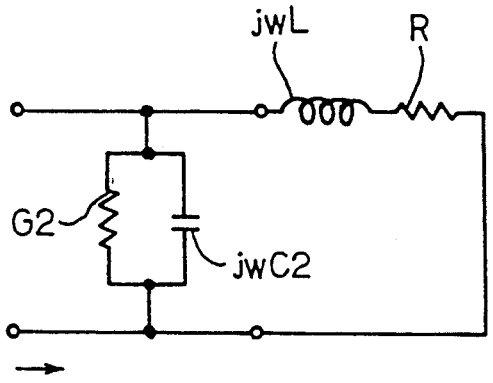
FIG. 3 is an equivalent circuit produced in the electromagnetic wave absorber shown in FIG. 1.

In other words, the reflection of the incident electromagnetic wave and the transmission property of the absorber are analyzed by using the equivalent circuit shown in FIG. 3. R, jwL, G2 and jwC2 of FIG. 3 are given as follows.

$$R = Z0(w / c0)\ mu''d1$$

$$jwL = Z0(w / c0)\ mu'd1$$

$$G2 = (1/ Z0)\ (w/c0)\ epsilon2''d2$$

$$jwC'' = (1 / Z0)\ (w / c0)\ epsilon2'd2$$

where Z0 is a characteristic impedance of space occupied by the first conductive film structure 1 and the magnetic film 2, w is an angular frequency given as (2×ph×f), f is the frequency, c0 is propagation speed of the incident electromagnetic wave in the space, d1 is the thickness of the magnetic film 2, d2 is the thickness of the first conductive film structure 1, and epsilon2' and epsilon2'' are the real part and the imaginary part of the permeability of the first conductive film structure 1. In the equivalent circuit shown in FIG. 3, jwL and jwC2 form the resonant circuit, and the resonant circuit decreases reflection of the incident electromagnetic wave to zero when the input impedance in view of the surface of the first conductive film structure 1 is equal to the characteristic impedance Z0 of the space. If an input admittance Yin of the equivalent circuit shown in FIG. 3 is equal to 1/Z0, the input impedance is matched with the characteristic impedance. We firstly determine the resonant condition where the imaginary part of the input admittance Yin is zero, and, subsequently, consider the matching condition where the real part of the input admittance Yin is equal to 1/Z0.

The resonant condition and the matching condition are respectively given by Equations 1 and 2

$$1 = c0/(w\ epsilon2'd2)(c0/w\ d1)\{mu''/(mu'^2 + mu''^2)\} \quad \text{Equation 1}$$

$$1 = (w\ epsilon2''\ d2\ /c0) + (co/w\ d1)\{mu''/(mu'^2 + mu''^2)\} \quad \text{Equation 2}$$

In Equations 1 and 2, the permeability (mu', mu'') affects the terms (c0/w d1){mu'/(mu'$^2$+mu''$^2$) and (co/w d1){mu''/(mu'$^2$+mu''$^2$), and the resin film containing the ferrite ceramic particles has the mu' much larger than the mu''. The mu'' can be ignored, and the mu' is inversely proportional to the frequency of the incident electromagnetic wave. Then, mu'/(mu'$^2$+mu''$^2$) is assumed to be nearly equal to 1/mu', and mu''/(mu'$^2$+mu''$^2$) is assumed to be approximately zero. Since (w mu') is nearly equal to (2 pi M) where M is a constant, Equations 1 and 2 are rewritten as $$1 = c0/(w\ epsilon2'\ d2)c0(2\ pi\ M\ d1) \quad \text{Equation 3}$$

$$1 = (w\ epsilon2''d2\ /c0) \quad \text{Equation 4}$$

From Equation 3 and 4, we understand that the permeability of the magnetic film 2 does not relate to frequency characteristics of the resonant condition, nor to the matching condition.

Figure 4:
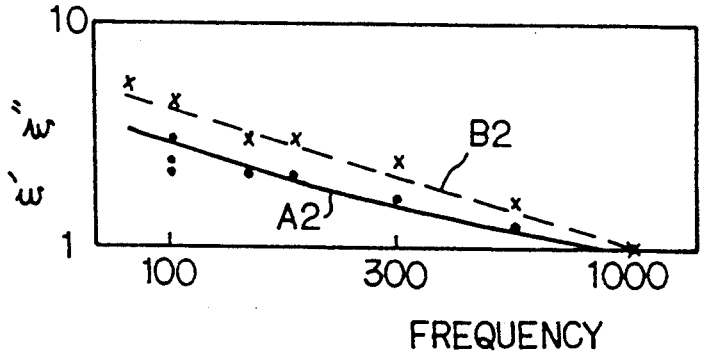
FIG. 4 is a graph showing frequency characteristics of the dielectric constant for a carbon-contained foam resin.

Subsequently, the dielectric constant of the first conductive film structure is discussed in detail. FIG. 4 shows the frequency characteristics of dielectric constant for a carbon-contained foam resin. In FIG. 4, the dielectric constant is expressed as a function of xi' and xi'', and plots A2 and B2 respectively stand for the xi' and the xi''. The xi' and xi'' illustrate that the dielectric constant is inversely proportional to the frequency of an incident electromagnetic wave, and it is possible to make the term (w epsilon2') of Equation 3 and (w epsilon2'') of Equation 4 equal to (2 pi P') and (2 pi P''), respectively, where P and P'' are constants. Therefore, the resonant condition and the matching condition are rewritten as $$1 = c0/(2\ pi\ P'\ d2)\ c0/(2\ pi\ M\ d1) \quad \text{Equation 5}$$

$$1 = (2\ pi\ P''\ d2\ /\ c0) \quad \text{Equation 6}$$

Equations 5 and 6 do not contain any term dominated by the frequency of the incident electromagnetic wave, and the resonant condition and the matching condition are never dependent on the frequency of the incident electromagnetic wave. This is because of the fact that the permeability of the magnetic film 2 and the dielectric constant of the first conductive film structure 1 are approximated to be inversely proportional to the frequency of the incident electromagnetic wave. If the approximation is closer to the actual frequency characteristics, Equations 5 and 6 precisely express the resonant and matching conditions, and the absorbing characteristics are achieved in a wide band range.

As described hereinbefore, the impedance of the magnetic film 2 is given by the product of the permeability and the thickness d1, and the admittance of the first conductive film structure 1 is given as the product of the dielectric constant and the thickness d2. If the thicknesses d1 and d2 are regulated depending upon the permeability and the dielectric constant, the optimum impedance and the optimum admittance are given to the electromagnetic wave absorber. Since the mu'' can be ignored in Equation 1 in the resonant condition, Equation 1 is rewritable as $$1 = c0/(w\ epsilon2'\ d2)(c0/w\ mu'\ d1) \qquad \text{Equation 7}$$

Using Equation 7, we can estimate the thicknesses d1 and d2. For example, if the mu' and the epsilon2' are 20, the product of the thicknesses d1 and d2 is 0.00057. If the thickness d1 is 10 millimeters, the first conductive film structure 1 is about 57 millimeter thick. However, if the magnetic film is about 30 millimeter in thickness, d2 should be adjusted to 19 millimeter. The thicker the magnetic film 2 is, the thinner the first conductive film structure 1 is. Thus, the product of the thicknesses d1 and d2 is calculated from the permeability and the dielectric constant. If the mu' of the magnetic film 2 ranges from 10 to 50 at 100 MHz and the epsilon' of the first conductive film structure 1 ranges from 10 to 100 at 100 MHz, the thicknesses d1 and d2 are selectable from a fairly wide rage. However, a substance preferable for the magnetic film 2 is generally larger in the specific gravity than a substance preferable for the first conductive film structure 1. For this reason, it is desirable for the electromagnetic wave absorber to decrease the thickness d1, and the magnetic film 2 ranges from 3 millimeters to 50 millimeters thick. This results in that the first conductive film structure 1 ranges from 3 millimeters to 100 millimeters.

The magnetic film 2 is formed of the resin film containing the ferrite in the Ni-Zn system. However, another ferrite with the spinel structure such as Mn-Zn system is available for the magnetic film 2 because of the permeability equivalent to that of the ferrite in the Ni-Zn system.

In general, the permeability of ferrite is decreased with grain size, and it is desirable for the magnetic film 1 to be formed of a substance having a large real part of the permeability, because the large real part allows the magnetic film 2 to be thin. However, the grain size can not exceed the thickness d1, and the grain size ranges from 0.1 millimeter to 3 millimeter in this instance. If the content of the ferrite powder is small, the mu' becomes small, and, accordingly, the electromagnetic wave absorber requires a thick magnetic film. Moreover, when the ferrite content is small, the frequency characteristics of the mu' are left from the inverse proportion, and the electromagnetic wave absorber is only effective against a narrow band range. Although the optimum ferrite content is partially dependent upon resin to be used for the magnetic film 2, the ferrite content is preferably not less than 70% by weight.

The imaginary part epsilon'' of a substance available for the first conductive film structure 1 preferably ranges from 10 to 100. In this instance, the first conductive film structure 1 is formed of the resin consisting of carbon particles as described hereinbefore. However, if the epsilon'' is fallen within the range between 10 to 100, any conductive substance is available. For example, the first conductive film structure 1 may be formed of any one of conductive substances containing conductive metal and/or conductive alloy powders such as copper, nickel, aluminum and iron, conductive metallic fibers and carbon fibers. The conductive metal, the conductive alloy and the carbon fibers may be contained in a resin. The real part epsilon' of the dielectric constant should be also regulated to 10 to 100. If the carbon, metal or alloy content is decreased, the first conductive film structure 1 increases the real part epsilon' only. Epoxy resin, chloroprene rubber, polyethylene and polystyrene are available for the magnetic film 2, and the magnetic film 2 may be formed from non-woven fabric of fiber resin containing the carbon, metal or alloy.

Figure 5:
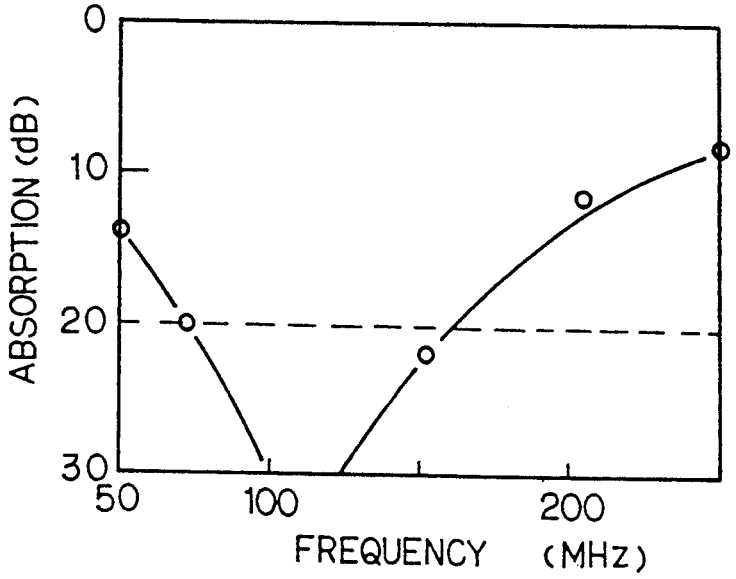
FIG. 5 is a graph showing the frequency characteristics of absorption achieved by a first specimen of the first embodiment.

First and second specimens are fabricated for evaluation. The first speciment has the magnetic film 2 formed of a resin containing ferrite ceramic particles in the Ni-Zn system at 90% by weight, and the grain size is about 1 millimeter. The resin containing the ferrite ceramic particles traces plots A1 and B1, and the dielectric constant is inversely proportional to the frequency of the incident electromagntic wave. The dielectric constant at 100 MHz is used for the first conductive film structure 1, and the dielectric constant at 100 MHz is (10 -j50). The magnetic film 1 is about 30 millimeter thick, and the first conductive film structure 1 is as thin as 7 millimeter. The frequency characteristics of absorption are shown in FIG. 5. If a specific band width is defined as band width/target frequency (100 MHz), the first specimen achieves the specific band width of about 78%. Thus, the first specimen is excellent in absorption, and the magnetic film 2 imparts flexibility to the electromagnetic wave absorber.

Figure 6:
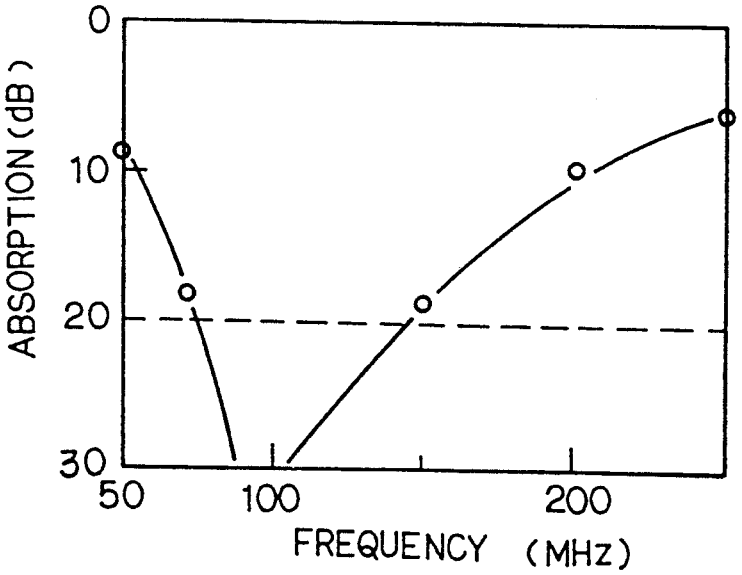
FIG. 6 is a graph showing the frequency characteristics of absorption achieved by a second specimen of the first embodiment.

The second specimen is similar in structure to the first specimen except for the thicknesses d1 and d2 as well as the dielectric constant of the first conductive film structure 1. The thicknesses d1 and d2 are 15 millimeter and 8 millimeter, and the dielectric constant at 100 MHz is expressed as (50 - j40). The frequency characteristics of the second specimen is shown in FIG. 6, and the specific band width of about 64% is achieved.

Second Embodiment

Figure 7:
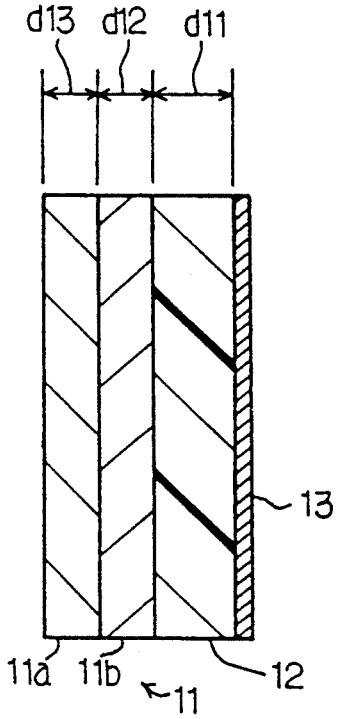
FIG. 7 is a cross sectional view showing the structure of another electromagnetic wave absorber according to the present invention.

Turning to FIG. 7 of the drawings, another electromagnetic wave absorber embodying the present invention largely comprises a first conductive film structure 11, a magnetic film 12 and a second conductive film 13, and the first conductive film structure 11 is implemented by two conductive films 11*a* and 11*b* laminated on each other. References d13, d12 and d11 are respectively indicative of the thicknesses of the conductive films 11*a* and 11*b* and the magnetic film 12, and the thicknesses d11, d12 and d13 are regulated to be much smaller than the wavelength of an incident electromagnetic wave of the VHF to UHF band as similar to the first embodiment. The magnetic film 12 is formed of a resin film containing ferrite ceramic powder, and the second conductive film 13 is formed of metal.

Figure 8:
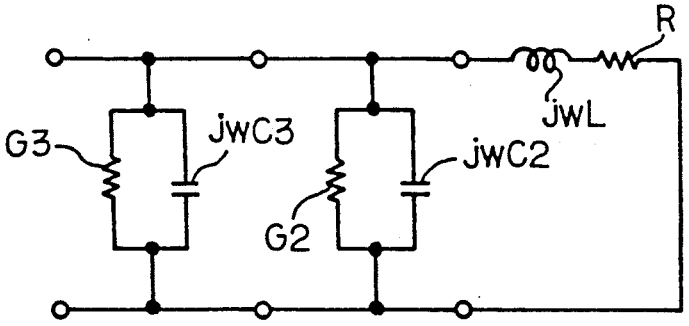
FIG. 8 is a diagram showing an equivalent circuit of the electromagnetic wave absorber shown in FIG. 5.

The conductive films 11*a* and 11*b* and the magnetic film 12 have equivalent capacitive reactances jwC2 and jwC3 and an equivalent inductive reactance jwL, and a loss factor is provided by both of the first conductive film structure 11 and the magnetic film 12. The equivalent capacitive reactances jwC2 and jwC3, the equivalent inductive reactance jwL and the loss factor form a resonant circuit shown in FIG. 8, and the parallel combination of G3 and jwC3 are additionally coupled in parallel with the parallel combination of G2 and jwC2 of the equivalent circuit shown in FIG. 3. Assuming now that the conductive film 11*a* has a dielectric constant consisting of the real part epsilon2' and the imaginary part epsilon3'', Equations 1 to 6 are applicable to the equivalent circuit shown in FIG. 8 if G2 and C2 in Equations 1 to 6 stand for (G2 +G3), i.e., (epsilon2' d2)=(epsilon2' d2+epsilon3' d3) and (C2+C3), i.e., (epsilon2'' d2)=(epsilon2'' d2+epsilon3'' d3), and excellent absorbing characteristics are achieved for a wide band range. The multi-level first conductive film structure 11 is desirable, because the matching condition and the resonant condition are adjustable with the component conductive films 11*a* and 11*b*, respectively. In detail, the real part and the imaginary part of the dielectric constant respectively relate to the matching condition and the resonant condition. If the conductive film 11*a* is formed of a substance with a large real part of the dielectric constant, the conductive film 11*a* mainly regulates the matching condition. Similarly, the conductive film 11*b* formed of a highly conductive substance with a large imaginary part of the dielectric constant is used for regulation of the resonant conduction. However, the characteristics of the electromagnetic wave absorber are not dependent upon assignment of the films 11*a* and 11*b*, and, accordingly, the resonant condition and the matching condition may be regulated with the conductive films 11*a* and 11*b*, respectively.

The discussion on the thickness, the ferrite powder, the grain size, the ferrite content, the conductive substance and the resin available for the magnetic film of the first embodiment are appropriate for the second embodiment.

As will be appreciated from the foregoing description, the electromagnetic wave absorber according to the present invention is flexible without sacrifice of excellent absorption. A wide and large structure can be constructed from the electromagnetic wave absorber.

Although particular embodiments of the present invention have been shown and described, it will be obvious to those skilled in the art that various changes and modifications may be made without departing from the spirit and scope of the present invention.

What is claimed is:

1. An electromagnetic wave absorber for electromagnetic waves in the very high frequency to ultra high frequency band, comprising:

a) a first conductive film structure having a surface and having a first capacitive reactance and a loss factor;

b) a magnetic film comprising a resin film containing ferrite ceramic particles laminated on the surface of said first conductive film structure and having an inductive reactance and a loss factor, the capacitive reactance and the loss factor of said first conductive film and the inductive reactance and the loss factor of said magnetic film forming a resonant circuit which is matched with a characteristic impedance of a space occupied by said first conductive film and said magnetic film when the resonant circuit is in the resonant condition; and c) a second conductive film laminated on the opposite surface of said magnetic film to the surface attached to said first conductive film structure, and having reflecting characteristics substantially equivalent to metal.

2. An electromagnetic wave absorber as set forth in claim 1, in which the resin film contains ferrite ceramic particles with a spinel structure at a predetermined percentage equal to or more than 70% by weight.

3. An electromagnetic wave absorber as set forth in claim 2, in which the ferrite ceramic particles are about 0.1 millimeter to 3 millimeter in grain size.

4. An electromagnetic wave absorber as set forth in claim 3, in which the ferrite ceramic particles are formed of ferrite selected from a group consisting of Ni-Zn alloy and Mn-Zn alloy.

5. An electromagnetic wave absorber as set forth in claim 4, in which the thickness of said magnetic film ranges from about 3 millimeters to about 50 millimeters.

6. An electromagnetic wave absorber as set forth in claim 5, in which said second conductive film is implemented by a textile fabric formed from metal fibers.

7. An electromagnetic wave absorber as set forth in claim 3, in which the ferrite ceramic particles are dispersed in a resin reselected from a group consisting of eposy resin, chloroprene rubber, polyethylene and polystyrene.

8. An electromagnetic wave absorber for electromagnetic waves in the very high frequency to ultra high frequency band, comprising:

a first conductive film structure comprising a single conductive film selected from a resin containing carbon particles, a conductive substance containing conductive metal powder of copper, nickel, aluminum or iron, a conductive substance containing a conductive alloy, a conductive substance containing conductive metal fibers and a conductive substance containing carbon fibers;

a magnetic film comprising a resin fil laminated on the surface of said first conductive film structure, said magnetic film having a thickness ranging from about 3 millimeters to about 50 millimeters;

ferrite ceramic particles embedded in the resin film and selected from a group consisting of Ni-Zn alloy Mn-Zn alloy, said ferrite ceramic particles having a grain size of between about 0.1 millimeters to 3 millimeters;

a second conductive film laminated on the opposite surface of said magnetic film to the surface attached to said first conductive film structure, and having reflecting characteristics substantially equivalent to metal.

9. An electromagnetic wave absorber as set forth in claim 8, in which said first conductive film structure has a dielectric constant expressed by a real part and an imaginary part ranging from 10 to 100.

10. An electromagnetic wave absorber as set forth in claim 9, in which said real part ranges from 10 to 100.

11. An electromagnetic wave absorber for electromagnetic waves in the very high frequency to ultra high frequency band, comprising:

a first conductive film structure comprising a first conductive film member laminated to a second conductive film member;

a magnetic film comprising a resin film laminated on a surface of said first conductive film structure, said magnetic film having a thickness ranging from about 3 millimeters to about 50 millimeters;

ferrite ceramic particles embedded in the resin film and selected from a group consisting of Ni-Zn alloy and Mn-Zn alloy, said ferrite ceramic particles having a grain size of between about 0.1 millimeters to 3 millimeters;

a second conductive film structure laminated on the opposite surface of said magnetic film to the surface attached to said first conductive film structure, and having reflecting characteristics substantially equivalent to metal.

12. An electromagnetic wave absorber as set forth in claim 11, in which the resonant circuit has a resonant condition and a matching condition, and in which one of said two conductive films has a dielectric constant expressed by a first real part and a first imaginary part, said first real part being adjusted to a first predetermined value for satisfying said matching condition, the other of said two conductive films having a dielectric constant expressed by a second real part and a second imaginary part, said second imaginary part being adjusted to a predetermined value for satisfying said resonant condition.

13. An electromagnetic wave absorber for electromagnetic waves in the very high frequency to ultra high frequency band, comprising:

a first conductive film structure having first and second surfaces;

a magnetic film comprising a resin film free from metallic fiber for maintaining a high input impedance, said magnetic film being laminated on the first surface of said first conductive film structure;

a plurality of ferrite ceramic particles embedded in the resin film;

a second conductive film laminated on the second surface of said magnetic film, said second conductive film having reflecting characteristics substantially equivalent to metal and said first conductive film structure, said magnetic film and said second conductive film forming a resonant circuit for absorbing electromagnetic waves.

14. An electromagnetic wave absorber as set forth in claim 13 wherein said first conductive film structure and said magnetic film, respectively, have a capacitive reactance and an inductive reactance which are equivalent, and said first conductive film structure and said magnetic film have a loss factor, so that the equivalent capacitive reactance, the inductive reactance and the loss factor comprise a resonant circuit matched with a characteristic impedance of a space occupied by said first conductive film structure and said magnetic film when said resonant circuit is in resonant condition.

* * * * *

UNITED STATES PATENT AND TRADEMARK OFFICE

CERTIFICATE OF CORRECTION

PATENT NO. : 5,179,381

DATED : January 12, 1993

INVENTOR(S) : Kenichi Hatakeyama

It is certified that error appears in the above-identified patent and that said Letters Patent is hereby corrected as shown below:

Claim 1, col. 7, line 44, delete "and".

Claim 8, col. 8, line 23, change "fil" to --film--.

Claim 8, col. 8, line 28, after "alloy" insert --and--.

Signed and Sealed this

Sixteenth Day of November, 1993

Bruce Lehman

*Attest:*

BRUCE LEHMAN

*Attesting Officer*

*Commissioner of Patents and Trademarks*